US009508252B2

(12) United States Patent
Yarygin

(10) Patent No.: US 9,508,252 B2
(45) Date of Patent: Nov. 29, 2016

(54) CONTROL TARGET SELECTION

(71) Applicant: Lattice Semiconductor Corporation, Portland, OR (US)

(72) Inventor: Sergey Yarygin, San Jose, CA (US)

(73) Assignee: Lattice Semiconductor Corporation, Portland, OR (US)

( * ) Notice: Subject to any disclaimer, the term of this patent is extended or adjusted under 35 U.S.C. 154(b) by 0 days.

(21) Appl. No.: 14/578,266

(22) Filed: Dec. 19, 2014

(65) Prior Publication Data

US 2015/0325110 A1 Nov. 12, 2015

Related U.S. Application Data

(60) Provisional application No. 61/989,417, filed on May 6, 2014.

(51) Int. Cl.
*G08C 17/02* (2006.01)

(52) U.S. Cl.
CPC ..... *G08C 17/02* (2013.01); *G08C 2201/30* (2013.01)

(58) Field of Classification Search
CPC .. G08C 17/02; G08C 2201/30; G08C 25/00; H05B 37/0245; B61L 3/127; H04L 12/12
See application file for complete search history.

(56) References Cited

U.S. PATENT DOCUMENTS

| | | | | |
|---|---|---|---|---|
| 7,865,568 | B1 | 1/2011 | Redi | |
| 2012/0026409 | A1 | 2/2012 | Higuchi et al. | |
| 2012/0178371 | A1 | 7/2012 | Patel et al. | |
| 2012/0209938 | A1* | 8/2012 | Nagano | H04N 5/765 709/208 |
| 2012/0278759 | A1 | 11/2012 | Curl et al. | |
| 2013/0321124 | A1* | 12/2013 | Shibata | G05B 1/01 340/5.6 |
| 2014/0055682 | A1 | 2/2014 | Ohashi | |
| 2014/0176313 | A1* | 6/2014 | Richardson | G08C 17/00 340/12.29 |
| 2015/0042447 | A1* | 2/2015 | Vogt | G08C 17/02 340/4.41 |
| 2015/0194047 | A1* | 7/2015 | Lu | G08C 17/02 340/12.28 |
| 2015/0228266 | A1* | 8/2015 | Higuchi | G10K 11/16 381/71.11 |
| 2015/0281761 | A1* | 10/2015 | Mank | H04N 21/64322 725/37 |

OTHER PUBLICATIONS

PCT International Search Report and Written Opinion, PCT Application No. PCT/US2015/027241, Jul. 21, 2015, 13 pages.
"High-Definition Multimedia Interface," Specification Version 1.3a, Hitachi, Ltd. et al., Nov. 10, 2006, 276 pages, [Online] [Retrieved on Apr. 8, 2014] Retrieved from the Internet<URL:http://www.microprocessor.org/HDMISpecification13a.pdf>.

* cited by examiner

*Primary Examiner* — Hirdepal Singh
(74) *Attorney, Agent, or Firm* — Fenwick & West LLP

(57) ABSTRACT

A system of devices includes a plurality of devices such as a sink device, a source device and an intermediate device. In one embodiment, a first device propagates to a second device, via a multimedia link, an address of the first device in association with an indication that the first device is a master for a remote control command type. The second device responsive to receiving a remote control command from a remote control identifies the remote control command type of the remote control command. Responsive to the command type of the received remote control command being the remote control command type that the first device is the master for, the second device forwards the received remote control command using the address of the first device. The first device upon receiving the remote control command modifies a multimedia output by the first device based on the remote control command received.

19 Claims, 5 Drawing Sheets

| Remote Control Command Type 400 | Target Address 430 |
|---|---|
| Audio 405 | Address of Intermediate Device 120 |
| Playback 410 | Address of Source Device 110 |
| GUI 415 | Address of Sink Device 140 |

FIG. 4

CONTROL TARGET SELECTION

CROSS-REFERENCE TO RELATED APPLICATION

This application claims priority from U.S. Provisional Patent Application No. 61/989,417, titled "Control Target Selection" filed on May 6, 2014, the contents of which are incorporated by reference herein in their entirety.

BACKGROUND

1. Field of the Disclosure

This disclosure pertains in general to data communications, and more specifically to the communication of remote control commands from a remote control to a device in a system of devices.

2. Description of the Related Art

A remote control is used to change the behavior of the device paired with the remote control. However, in systems including a plurality of devices connected to one another, it is difficult to use a remote control to control all of the devices. One solution for controlling multiple devices with a remote includes passing through or tunneling remote control commands from one device to another. However, pass through is not appropriate in a multi-streaming environment when a source device is streaming to multiple sink devices and does not allow for proper decision making on remote control forwarding when many devices are connected to each other.

SUMMARY

Embodiments of the present disclosure are related to the handling and communication of remote control commands received by a system of devices. In one embodiment, a first device, such as a sink device, propagates to a second device, such as a source device, via a multimedia link, an address of the first device in association with an indication that the first device is a master for a remote control command type. The indication may indicate that the first device is a master for graphical user interface (GUI) remote control commands, playback control commands, or audio control commands. The second device may store the address of the first device and identify the address to be the address of the master for the remote control command type. The second device responsive to receiving a remote control command from a remote control identifies the remote control command type of the remote control command. Responsive to the command type of the received remote control command being the remote control command type that the first device is the master for, the second device forwards the received remote control command using the address of the first device. The first device upon receiving the remote control command may modify a multimedia output by the first device based on the remote control command received.

In one embodiment, a third device in the system of devices, propagates to the second device an address of the third device in associated with an indication that the third device is the master for another remote control type. The second device may receive another remote control command and upon determining that the command type of the other remote control command is that of the remote control command type that the third device is master for, forwards the other remote control command using the address of the third device. The second device may also propagate to the third device the address of the first device and the indication that the first device is the master for the type of remote control command. The third device upon receiving a remote control command from a remote control determines if the received remote control command is the remote control command type for which the first device is master. On determining that the received remote control command is the remote control command type that the first device is master for, the third device forwards to the second device the received remote control command and the address of the first device.

In one embodiment, a first device includes an interface circuit to communicate with a second device via a multimedia link and a wireless receiver to receive remote control commands from a remote control. The first device may receive from the second device an address of the second device in associated with an indication that the second device is master of a remote control command type. The first device upon receiving a remote control command from the remote control identifies a type of the remote control command. The first device forwards the received remote control command using the address of the second device upon identifying that the type of the received remote control command is the remote control command type for which the second device is master.

BRIEF DESCRIPTION OF THE DRAWINGS

The teachings of the embodiments disclosed herein can be readily understood by considering the following detailed description in conjunction with the accompanying drawings.

FIG. 4 is an example table storing information identifying the various devices in the system that are currently assigned as the control master for a remote control command type.

DETAILED DESCRIPTION

The Figures (FIG.) and the following description relate to various embodiments by way of illustration only. It should be noted that from the following discussion, alternative embodiments of the structures and methods disclosed herein will be readily recognized as viable alternatives that may be employed without departing from the principles discussed herein. Reference will now be made in detail to several embodiments, examples of which are illustrated in the accompanying figures. It is noted that wherever practicable similar or like reference numbers may be used in the figures and may indicate similar or like functionality.

Figure 1:
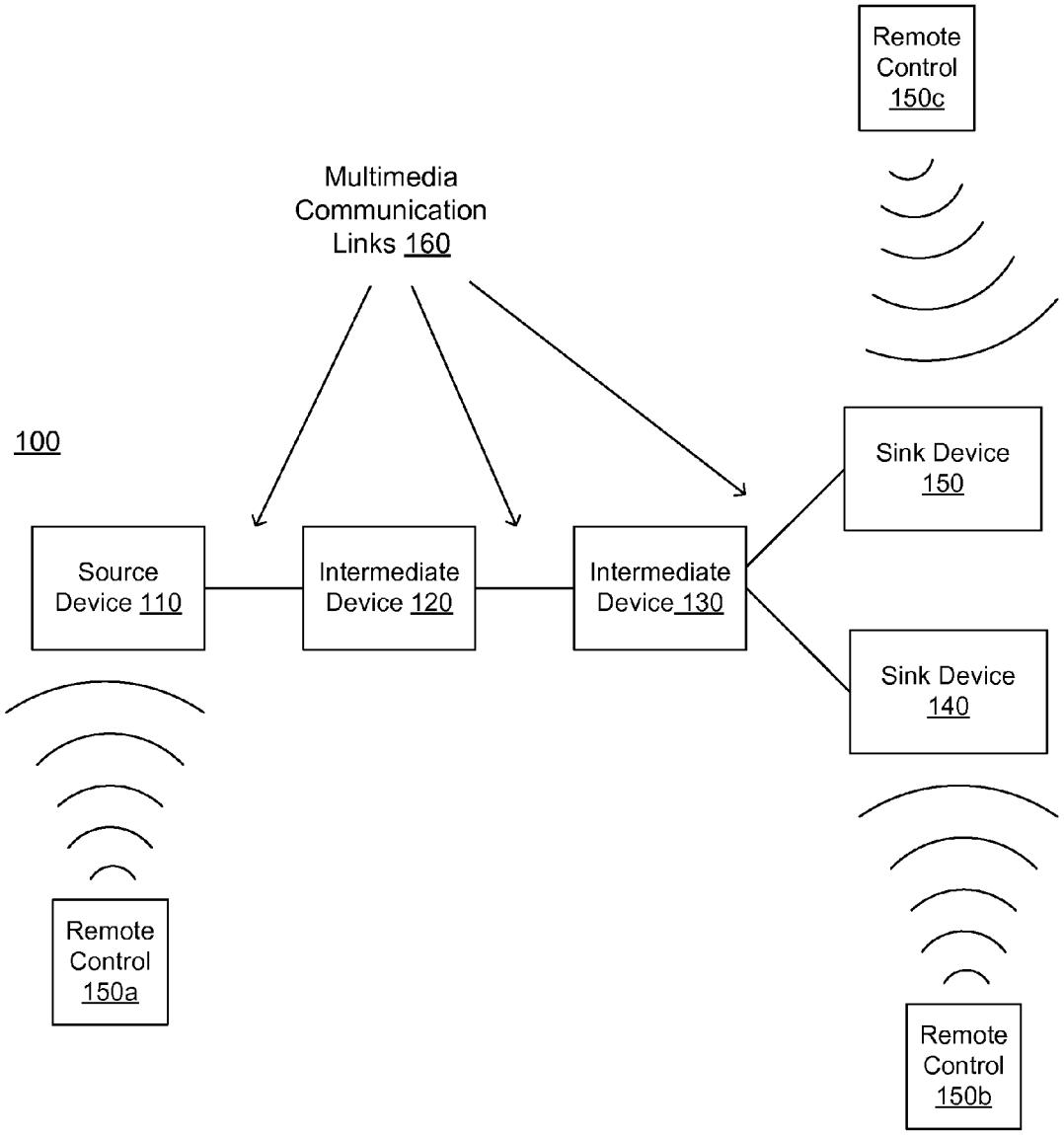
FIG. 1 is a high-level block diagram of a system for data communications, according to one embodiment.

FIG. 1 is a high-level block diagram of a system 100 for data communications, according to one embodiment. The system 100 includes a source device 110, a sink device 140, another sink device 150, and two intermediate devices 120 and 130, communicating with one another through different multimedia communication links 160. In one embodiment, source device 110, intermediate devices 120, 130 and sink device 140 form a single logical connection for multimedia data streams. Source device 110, intermediate devices 120, 130 and sink device 150 may form another logical connection for additional multimedia data streams. A logical connection is a logical path between source and sink devices for a multimedia stream. Multiple logical connections allow for multi-streaming such that one source device 110 can concurrently send multiple multimedia streams to devices along the logical connections. Only the operations for one logical connection will described herein, but the principles described herein are can also be applied to the other logical connection.

The source device 110 transmits multimedia data streams (e.g., audio/video streams) and control data associated with the multimedia data streams to the intermediate devices 120 and 130, and the sink device 140 through the multimedia communication links 160. The devices in the system 100 together provide audio and visual data to a user of the system 100 in a plurality of forms. For example, source device 110 can be a blu-ray player that outputs multimedia streams, intermediate device 130 is an audio video receiver (AVR) or sound bar that receives audio streams from the source device 110 and converts the audio streams into audio, and sink device 140 is a television that receives video streams from the source device 110 and displays the video streams. Intermediate device 130 can be a repeater.

The devices in the system 100 exchange data using various protocols. In one embodiment, the multimedia communication links 160 represent Mobile High-Definition Link (MHL) cables. The MHL cables support differential signals transmitted via data lines, which form a single logical communication channel for carrying multimedia data streams. In some embodiments of MHL, there may be more than a single pair of differential data lines. In some versions of MHL, embedded common mode clocks are transmitted through the differential data lines. The MHL cables 160 may further include a control bus (CBUS), power, and ground. The CBUS carries data such as discovery data, configuration data and remote control commands.

In one embodiment, the multimedia communication links 160 represent a High Definition Multimedia Interface (HDMI) cable. The HDMI cables 160 supports differential signals transmitted via data lines. Each differential pair of lines forms a logical communication channel that carries multimedia data streams. The HDMI cables 160 may further include differential clock lines; Consumer Electronics Control (CEC) control bus; Display Data Channel (DDC) bus; power, ground; hot plug detect; and four shield lines for the differential signals.

The system 100 also includes remote controls 150*a-c*. Each remote control 150 transmits remote control commands to a respective one of the devices in the system 100. For example, the remote control 150*b* transmits an audio command to the sink device 140, which is forwarded to the intermediate device 120 and causes the intermediate device 120 to raise the volume of the audio output to the user. As another example, the remote control 150*a* may transmit an audio command to the source device 110, which is then forwarded to the intermediate device 120.

The remote control commands may be transmitted wirelessly, via infrared (IR) signals for example, to the devices by the remote control 150. In one embodiment, the remote control 150 includes a control device for processing input commands received from a user and generating one or more remote control commands based on the received input commands. For example, the user may press a button on the remote control 150*b* corresponding to an input command for incrementally increasing the volume output by the sink device 140. The control device included in the remote control generates a remote control command to be transmitted to the sink device 140*b*, the remote control command specifying the incremental increase in audio volume.

Embodiments of the present disclosure relate to a system that can support different control masters for different types of remote control commands. The control master is the device of the various devices in the system 100 that is assigned to handle a particular type of remote control command. The other devices on receiving the remote control command transmit the remote control command to the control master via one or more multimedia communication links 160. This provides the ability for each remote control to control all devices along a single logical connection. Also, in a multi-stream environment, one remote control (e.g. control 150*c*) can be used for control of devices along that logical connection and another remote control (e.g. control 150*b*) can be used for control of devices along another logical connection.

Figure 2A:
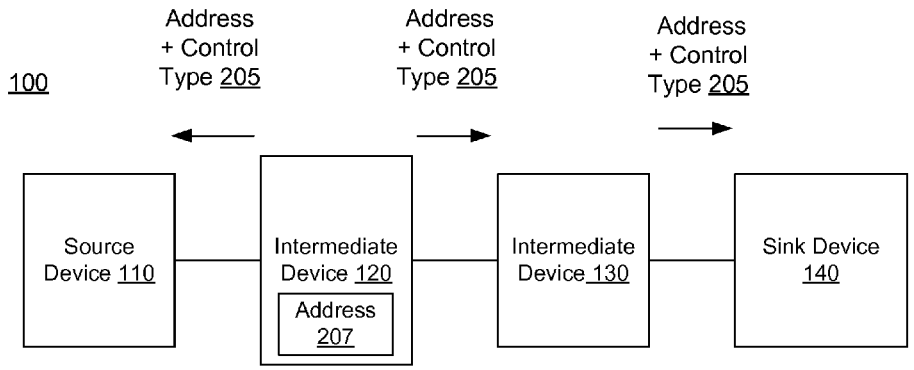
FIG. 2A is an example of a device in the system of devices propagating control information identifying a control master for a remote control command type, according to one embodiment.

FIG. 2A is an example of a device in the system of devices propagating control information identifying a control master for a remote control command type, according to one embodiment. Each device in the system 100 has an address. The address, unique to each device, identifies the device when the device is connected to the plurality of devices in the system 100, via the multimedia communication links 160 for example. In the example of FIG. 2, the intermediate device 120 has an address 207. Examples of the address include an information protocol address (IP address), an MHL address, an HDMI address, or a device identifier.

The user of the system 100 may assign the intermediate device 120 to be the control master for a remote control command type. Remote control commands can generally be divided into different types of commands. Examples of remote control command types include audio control commands (e.g., volume up/down and mute on/off), multimedia playback control commands (e.g., play, pause, rewind), and graphical user interface (GUI) commands (e.g., scroll left, right, up, down, enter and numbers in an on screen display OSD).

In the example of FIG. 2A, the intermediate device 120 is assigned to be the control master for a particular remote control command type (e.g., audio control). On being assigned as the control master for the control command type, the intermediate device 120 propagates a signal including the address 207 of the intermediate device 120 and an indication of the remote control command type that the intermediate device 120 is the control master for to the source device 110 to the intermediate device 130, and the sink device 140 via the multimedia communication links 160. By propagating the signal to the other devices connected to the intermediate device 120, the intermediate device 120 has made the other devices aware of the address of the control master for a particular remote control command type.

Similarly, although not shown in FIG. 2A, the other devices can also propagate signals including their own address an indication of what type of control command type they are master for. For example, source device 110 can propagate a signal including its own address and an indication that the source device 110 is the control master of a playback remote control commands to the intermediate devices 120, 130 and sink device 140. The other devices are thus made aware of the remote control command type that the source device 110 is the control master for.

Figure 2B:
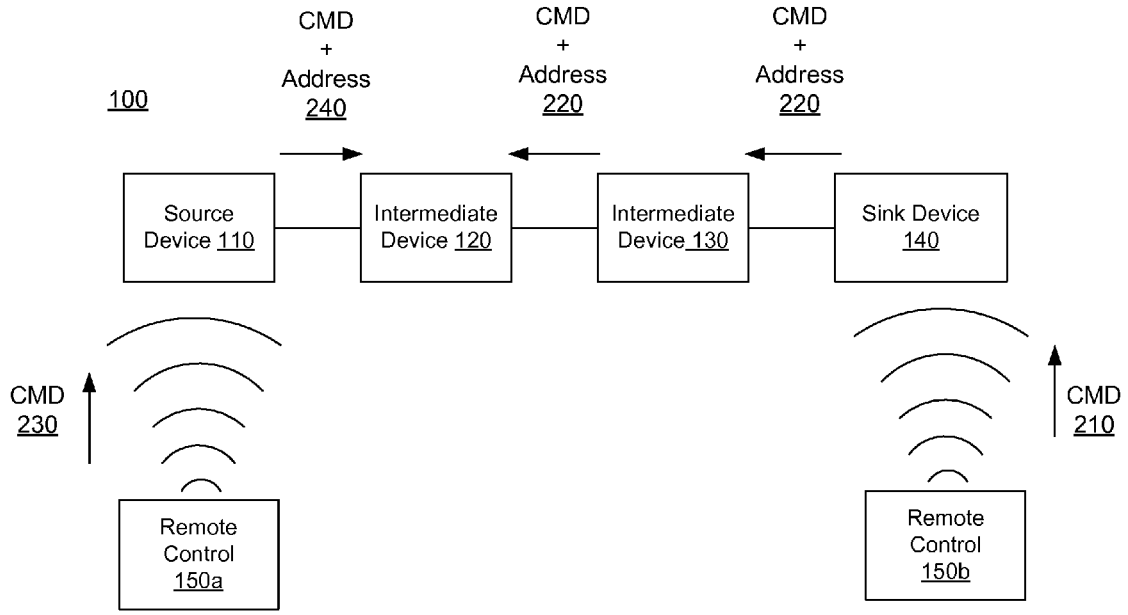
FIG. 2B is an example of a device in the system of devices forwarding a remote control command to the control master assigned to handle the remote control command, according to one embodiment.

Referring now to FIG. 2B, illustrated is an example of a device in the system of devices forwarding a remote control command to the control master assigned to handle the remote control command, according to one embodiment. Once the control master for a remote control command type has been established, future remote control commands associated with the remote control command type, received by any of the devices of the system 100 are forwarded or routed to the control master to be handled by the control master.

In the example of FIG. 2B, intermediate device 120 has been assigned as the control master for a particular control command type (e.g., audio control). The sink device 140 receives a remote control command 210 from the remote control 150*b*. The sink device 140 identifies the type of the received command 210 and determines that the intermediate device 120 is the control master for this command. The sink device 140 transmits the command 210 and the address 207 of the intermediate device 120 to the intermediate device 130. The intermediate device 130 then forwards the command 210 to the intermediate device 120 along with the address 220. Upon receiving the command, the intermediate device 120 modifies its output in accordance with the command. For example, if the command 210 is an audio command and the intermediate device 120 is the audio control master, the audio data output by the intermediate device 120 is changed in accordance with the audio command (e.g. by increasing the volume).

Similarly, source device 110 receives a command 230 from the remote control 150*a*. Source device 110 identifies a type of this command 230, and determines that intermediate device 120 is the master for this command 230. Source device 110 then forwards the command and the address 240 to the intermediate device 120, which modifies its output in accordance with the command.

Figure 3:
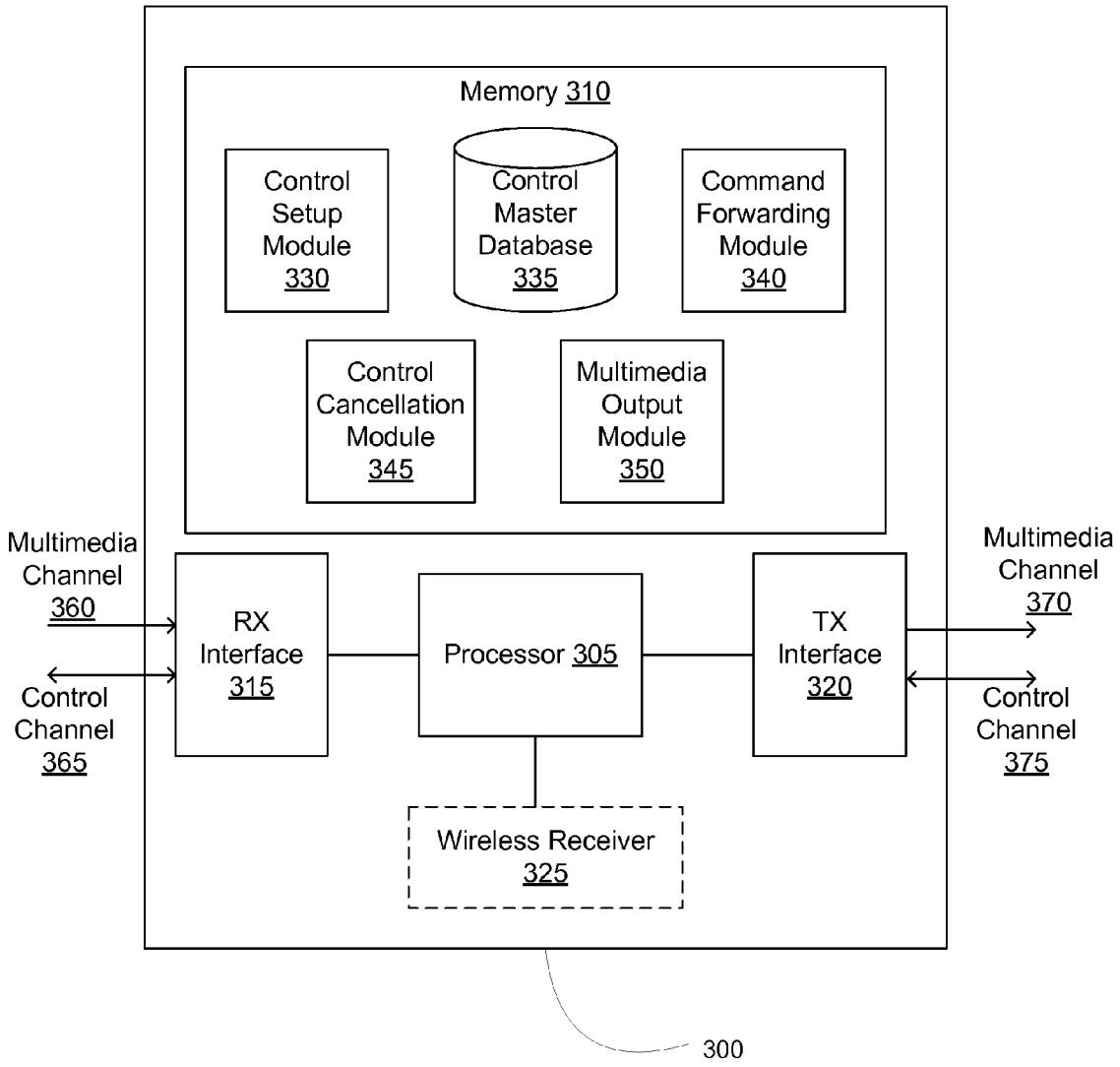
FIG. 3 is a block diagram of the sink device, according to one embodiment.

FIG. 3 is a block diagram of a device from FIG. 1, according to one embodiment. In one embodiment, the device 300 includes a processor 305, memory 310, a receiver interface 315, a transmitter interface 320, and a wireless receiver 325. Any of the devices in the system environment 100 (i.e., the source device 110, intermediate device 120, intermediate device 130, sink device 140 and sink device 150) may be similar in structure and function as that of the device 300 described in FIG. 3.

Examples of the processor 305 include a central processing unit (CPU), a graphics processing unit (GPU), a digital signal processor (DSP), one or more application specific integrated circuits (ASICs), one or more radio-frequency integrated circuits (RFICs), or any combination of these. The processor 305 is configured to communicate with the memory 310, the receiver interface 315, the transmitter interface 320, and the wireless receiver 325 via one or more busses.

In one embodiment, the memory 310 includes a non-transitory machine-readable medium on which is stored modules (e.g. software instructions) that are executed by the processor 305 to perform the methodologies or functions described herein. The modules may also reside, completely or at least partially, within the processor 305 (e.g., within a processor's cache memory) during execution thereof by the sink device 140, the memory 310 and the processor 305 also constituting non-transitory machine-readable media.

In one embodiment, the memory 310 includes a control setup module 330, a control master database 335, a command forwarding module 340, a control cancellation module 345, and a multimedia output module 350. In one embodiment, the control setup module 330 propagates a control setup signal notifying the other devices in the system environment 100 that the device 300 has been assigned as the control master for a remote control command type. The control setup signal may include the address associated with the device 300, an indication that the device 300 is the control master for the remote control command type for which the device 300 has been assigned as the control master. In some examples, the control setup signal also includes an identifier identifying the remote control command type. In one embodiment, the control setup module 330 generates the control setup signal, responsive to being assigned as the control master for the remote control command type by the user.

In one embodiment, the control setup module 330 manages control setup signals received by the device 300. For example, the control setup module 330, responsive to receiving a control setup signal, analyzes the control setup signal to identify the address associated with the other device and the type of remote control command for which the other device is the master. The control setup module 330 may store the address of the other device in the control master database 335 and associate the address with the identified remote control command type, thereby saving for future use the address of the control master for the identified remote control command type.

In the event that the device 300 has not received a control setup signal the control setup module 330 may identify a default device of the various devices in the system environment 100 as a control master for a specific remote control command type. In one embodiment, the control setup module 330 identifies the default device of the various devices in the system environment based on the capabilities of the device. For example, sink device 140 may be a television capable of displaying video data. The intermediate device 120 may be an AVR identifying that sink device 140 is capable of outputting video data and may identify the sink device 140 as the default device and control master for the video remote control command type. In another embodiment, the control setup module 330 may identify the device as the default control master for a remote control command type.

In one embodiment, the control setup module 330 is configured to route or forward control setup signals received from an external device connected to the device 300 to other devices 300 connected to the device. For example, assume device 300 is the intermediate device 130. The control setup module 330 may receive a control setup signal from intermediate device 120 identifying intermediate device 120 as the control master for the audio remote control command type. The control setup module 330 stores the address of intermediate device 120 in the control master database 335 in association with the audio remote control command type, thereby saving for future use the address of the control master associated with the audio remote control command type. The control setup module 330 may then forward or route the control setup signal to sink device 140, thereby notifying sink device 140 of intermediate device 120 being assigned as the control master for the audio remote control command type.

The control master database 335 stores information specifying addresses for the various devices in the system environment 100 that are currently assigned as the control master for various remote control command types. In one embodiment, the control master database 335 includes a table that stores an association between a target address and a remote control command type. The target address is the address of a device in the system environment 100 that is currently assigned as the control master for the remote control command type. FIG. 4 is an example table storing information identifying the various devices in the system 100 that are currently assigned as the control master for a remote control command type. The table in FIG. 4 includes a plurality of remote control command types 400 and the various target addresses 430 associated with each of the plurality of remote control command types 400. In the example of FIG. 4, the audio 405 remote control command type 400 is associated with the address of the intermediate device 120, the playback 410 remote control command type 400 is associated with the address of the source device 110, and the graphical user interface (GUI) 415 remote control command type 400 is associated with the address of the sink device 140. In other embodiments, the information identifying the target address 430 associated with a remote control command type 400 may be stored differently. Further, the control master database 335 may be accessed by other modules, such as the control setup module 330 to access and/or modify the information stored in the control master database 335. There may be different tables for different logical connections as different logical connections can have different control masters.

Returning now to the description of FIG. 3, the command forwarding module 340, in one embodiment, determines the remote control command type associated with a remote control command received by the device 300 from the remote control 150, identifies the control master of the determined remote control command type, and forwards the received command to the identified control master. In one example, the command forwarding module 340, responsive to receiving a remote control command from the remote control 150, identifies the remote control command type associated with the remote control command. The command forwarding module 340 responsive to identifying the remote control command type associated with the remote control command, accesses the control master database 335 to retrieve the address of the control master associated with the identified remote control command type. The command forwarding module 340 may then forward the remote control command to the address associated with the control master. For example, the command forwarding module 340 generates and sends a command forwarding signal including the address of the control master and the received remote control command. In one example, the command forwarding module 340 responsive to determining that the control master for a remote control command type associated with a received remote control command is the sink device 300 sends the received remote control command to the multimedia output module 350 to modify the multimedia output by the device 300 based on the remote control command.

In one embodiment, the command forwarding module 340 manages command forwarding signals received by the device 300. The command forwarding module 340 may receive a command forwarding signal including the address of the control master and the remote control command. The command forwarding module may then forward the command forwarding signal to the address of the control master or to an adjacent device connected to the device 300. In one example, the command forwarding module 340 may determine from analyzing a received command forwarding signal that the device 300 is the control master for the remote control command type. The command forwarding module 340 may then send the received remote control command to the multimedia output module 350 to modify the multimedia output by the device 300 based on the remote control command.

In on embodiment, the control cancellation module 345 propagates a control cancellation signal to the various devices in the system environment 100 notifying the various devices that the device 300 is no longer the control master for a remote control command type. In one example, the control cancellation signal includes the remote control command type and an indication that the device 300 is no longer the control master for the remote control command type.

In one embodiment, the control cancellation module 345 manages control cancellation signals received from other devices. The control cancellation module 345 responsive to receiving a control cancellation signal analyzes the control cancellation signal to identify the indication that an external device is no longer the control master for a remote control command type. The control cancellation module 345 may access the control master database 335 to identify the remote control command type identified in the control cancellation signal and erase the target address associated with the remote control command type, thereby disassociating the previous control master with the remote control command type.

The multimedia output module 350 formats and outputs multimedia to be presented to a user or to be transmitted to another device of the devices in the system environment. For example, the multimedia output module 350 may generate video data to be transmitted to an external device, such that the video data may be displayed to a user by the external device. The multimedia output module 350 modifies the multimedia stream output by the device 300 based on a remote control command received from the remote control 150. For example, the multimedia output module 350 modifies the volume of the audio data output by the device 300 responsive to receiving an audio remote control command. In one embodiment, the multimedia output module 350 receives a remote control command responsive to the command forwarding module 340 determining that the device 300 is the control master for the remote control command type associated with the remote control command.

The receiver interface 315 includes an interface circuit that is communicatively coupled to a multimedia link. The receiver interface 315 receives communications from external devices connected to the device 300 via a multimedia link 160. The multimedia link 160 includes a multimedia channel 360 for carrying a multimedia stream including audio data and video data, and a control channel 365 (e.g., CBUS, DDC) for carrying control codes, radio control commands, and signals associated with the setup and cancellation of a control master, and forwarding of remote control commands. The receiver interface 315 receives multimedia streams via the multimedia channel 360, and transmits or receives control setup signals, command forwarding signals, and control cancellation signals via the control channel 365.

The transmitter interface 320 includes an interface circuit that is communicatively coupled to another multimedia link. The transmitter interface 320 receives communications from devices connected to the device 300 via a multimedia link 160. The multimedia link 160 includes a multimedia channel 370 for carrying a multimedia stream including audio data and video data, and a control channel 375 for carrying control codes, radio control commands, and signals associated with the setup and cancellation of a control master, and forwarding of remote control commands. The transmitter interface 332 transmits multimedia streams via the multimedia channel 370, and transmits or receives control setup signals, command forwarding signals, and control cancellation signals via the control channel 375.

The wireless receiver 325 includes a circuit that receives wireless communications from the remote control 150. The wireless receiver 325 may be configured to receive a variety of wireless signals from the remote control 150, such as infrared (IR) signals or WiFi. The communications received by the wireless receiver 325 often include remote control commands generated by the remote control 150.

Figure 5:
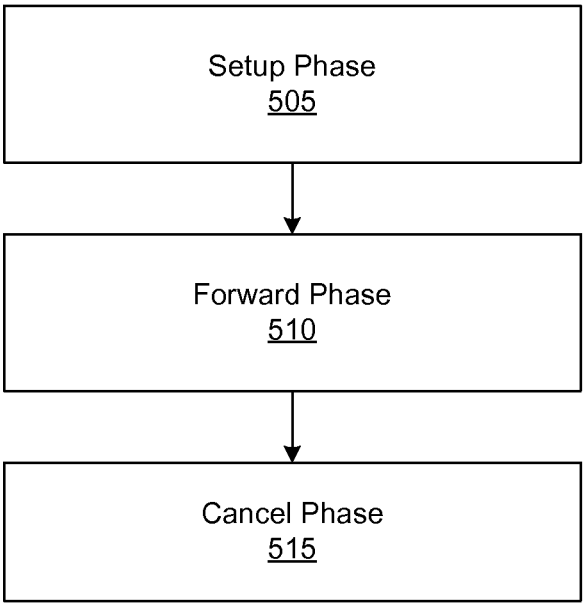
FIG. 5 is a flow chart describing the various phases associated with propagating a remote control command by a device, according to one embodiment.

FIG. 5 is a flow chart describing the various phases associated with propagating a remote control command by a device, according to one embodiment. A device initially executes a setup phase 505 to establish a control master for a remote control command type. The device may begin the setup phase 505 responsive to being selected as the control master for a remote control command by a user. The device, during the setup phase 505, propagates information to the other devices in the system environment 100 notifying the other devices that the device has been assigned as the control master for a given remote control command type. In one embodiment, the device, as described above, propagates a control setup signal including the address of the device and the remote control command type for which the device has been assigned as the control master. The device also receives control setup signals from other devices.

During the forward phase 510 the device receives remote control commands from the remote control 150 and forwards the remote control commands to the control master of the remote control command type associated with the received remote control commands. As described in conjunction with FIG. 3 above, the device identifies a remote control command type associated with a remote control command, identifies the address of the control master associated with the remote control command type, and forwards the remote control command to the identified control master. In one example, the device generates a command forwarding signal including the remote control command and the address of the control master, and forwards the command forwarding signal to the address of the control master or an adjacent device.

During the cancellation phase 515 the device propagates a cancellation command signal to the other devices in the system environment 100, notifying the other devices that the device is no longer assigned as the control master for a remote control command type. As described in conjunction with FIG. 3 above, the device may transmit a cancellation command signal including the remote control command type and an indication that the device is no longer the control master for the remote control command type.

Upon reading this disclosure, those of skill in the art will appreciate still additional alternative designs for assigning a control master for a remote control command type amongst a system of devices. Thus, while particular embodiments and applications of the present disclosure have been illustrated and described, it is to be understood that the embodiments are not limited to the precise construction and components disclosed herein and that various modifications, changes and variations which will be apparent to those skilled in the art may be made in the arrangement, operation and details of the method and apparatus of the present disclosure disclosed herein without departing from the spirit and scope of the disclosure as defined in the appended claims.

What is claimed is:

1. A method of handling remote control commands in a system of devices connected by multimedia links, the method comprising:

propagating, from a first device to a second device via a multimedia link, an address of the first device in association with an indication that the first device is a master for a remote control command type;

storing, at the second device, control master information associating the address of the first device with the remote control command type that the first device is master for;

receiving, at the second device, a remote control command from a remote control;

identifying, at the second device, a command type of the remote control command; and responsive to the control master information indicating that the command type of the received remote control command is the remote control command type that the first device is the master for, forwarding by the second device the received remote control command using the address of the first device stored in the control master information.

2. The method of claim 1, further comprising:

propagating, from a third device to the second device, an address of the third device and an indication that the third device is a master for another remote control command type; and responsive to the command type of the received remote control command being the another remote control command type that the third device is the master for, forwarding the received remote control command using the address of the third device.

3. The method of claim 2, further comprising:

propagating, from the second device to the third device, the address of the first device and the indication that the first device is the master for the type of remote control command;

receiving, at the third device, the remote control command;

determining, at the third device, if the received remote control command is the remote control command type that the first device is the master for; and responsive to determining that the received remote control command is the remote control command type that the first device is the master for, forwarding to the second device the received remote control command and the address of the first device.

4. The method of claim 3, further comprising:

receiving, at the second device from the third device, the remote control command received by the third device and the address of the first device;

determining, at the second device, if the received remote control command is the remote control command type that the first device is the master for; and responsive to determining that the received remote control command is the remote control command type that the first device is the master for, forwarding the received remote control command using the address of the first device.

5. The method of claim 1, further comprising:

propagating, from the first device to a third device, the address of the first device in association with the indication that the first device is the master for the remote control command type;

receiving, at the third device, another remote control command from another remote control;

identifying, at the third device, a command type of the another remote control command;

responsive the command type of the another remote control command being remote control command type that the first device is the master for, forwarding the another remote control command using the address of the first device.

6. The method of claim 1, further comprising:

propagating, from the first device to the second device, an indication that the first device is no longer the master for the remote control command type.

7. The method of claim 6, further comprising:

propagating, from the second device to the third device, the indication that the first device is no longer the master for the remote control command type responsive to receiving the indication from the first device.

8. The method of claim 1, wherein the indication is an indication that the first device is a master for one of graphical user interface (GUI) remote control commands, playback control commands, or audio control commands.

9. The method of claim 1, further comprising:

modifying, at the first device a multimedia output of the first device based on the remote control command received from the second device responsive to the received remote control command being the remote control command type that the first device is master for.

10. A first device, comprising:

an interface circuit to communicate with a second device via a multimedia link;

another interface circuit to communicate with a third device via another multimedia link; and a memory storing instructions, the instructions when executed by a processor cause the processor to:

transmit, to the second device, an address of the first device in association with an indication that the first device is master of a remote control command type;

transmit, to the third device, the address of the first device and the indication that the first device is master of the remote control command type;

receive, from the second device, a remote control command that is forwarded based on the address;

modify a multimedia output of the first device based on the received remote control command responsive to the received remote control command being the remote control command type that the first device is master for;

receive, from the third device, another remote control command that is forwarded based on the address; and modify the multimedia output of the first device based on the received another remote control command responsive to the received another remote control command being the remote control command type that the first device is master for.

11. The first device of claim 10, the instructions further comprising instructions to:

transmit, to the second device and the third device, an indication that the first device is no longer the master of the remote control command type.

12. The first device of claim 10, wherein the indication is an indication that the first device is a master for one of graphical user interface (GUI) remote control commands, playback control commands, or audio control commands.

13. A first device, comprising:

an interface circuit to communicate with a second device via a multimedia link;

another interface circuit to communicate with a third device via another multimedia link; and a memory storing instructions, the instructions when executed by a processor cause the processor to:

transmit, to the second device, an address of the first device in association with an indication that the first device is master of a remote control command type;

receive, from the second device, a remote control command that is forwarded based on the address;

modify a multimedia output of the first device based on the received remote control command responsive to the received remote control command being the remote control command type that the first device is master for;

receive, from the third device, an address of the third device in association with an indication that the third device is master of another remote control command type;

receive, from the second device, another remote control command;

determine if the another remote control command is the remote control command type that the third device is the master for; and forward the another remote control command to the third device using the address of the third device responsive to the another remote control command being the remote control command type that the third device is the master for.

14. A first device, comprising:

an interface circuit to communicate with a second device via a multimedia link;

a wireless receiver to receive a remote control command from a remote control; and a memory storing instructions, the instructions when executed by a processor cause the processor to:

receive, from the second device, an address of the second device in association with an indication that the second device is master of a remote control command type;

store, at the first device, control master information associating the address of the second device with the remote control command type that the second device is master for;

identify at the first device, a type of the remote control command received from the remote control; and responsive to the control master information indicating that the type of the received remote control command is the remote control command type that the second device is master for, forward by the first device the received remote control command using the address of the second device stored in the control master information.

15. The first device of claim 14, the instructions further comprising instructions to:

responsive to the type of the received remote control command being a remote control command type that the first device is master for, modify a multimedia output of the first device.

16. The first device of claim 14, wherein the indication is an indication that the first device is a master for one of graphical user interface (GUI) remote control commands, playback control commands, or audio control commands.

17. The first device of claim 14, the further comprising:

another interface circuit to communicate with a third device via another multimedia link; and the instructions further comprising instructions to:

propagate, responsive to receiving the indication from the second device, the address of the second device in association with the indication that the second device is master of the remote control command type.

18. The first device of claim 17, the instructions further comprising instructions to:

receive, from the third device, another remote control command and the address of the second device;

identify a type of the another remote control command; and responsive to the type of the another received remote control command being the remote control command type that the second device is master for, forward the received another remote control command using the address of the second device.

19. The first device of claim 14, the instructions further comprising instructions to:

receive, from the second device, an indication that the second device is no longer the master for the remote control command type.

* * * * *